US005470436A

United States Patent [19]

Wagle et al.

[11] Patent Number: 5,470,436

[45] Date of Patent: Nov. 28, 1995

[54] REWETTING OF PAPER PRODUCTS DURING DRYING

[75] Inventors: Dinkar G. Wagle, Monroe; Raymond A. Volpe, Highland Mills, both of N.Y.

[73] Assignee: International Paper Company, Purchase, N.Y.

[21] Appl. No.: 336,540

[22] Filed: Nov. 9, 1994

[51] Int. Cl.[6] ..... D21F 3/00; D21F 5/00; F26B 13/18; F26B 13/14

[52] U.S. Cl. ..... 162/207; 162/198; 162/205; 162/202; 34/444; 34/446

[58] Field of Search ..... 162/198, 202, 162/204, 205, 206, 207; 34/444, 446, 445

[56] References Cited

U.S. PATENT DOCUMENTS

| | | | |
|---|---|---|---|
| 2,661,669 | 12/1953 | Friedrich, Jr. | 92/38 |
| 3,037,706 | 6/1952 | Dupasquier | 239/120 |
| 3,467,541 | 9/1969 | Aronsson et al. | 117/93.4 |
| 3,838,000 | 9/1974 | Urbas | 162/207 |
| 3,948,721 | 4/1976 | Winheim | 162/207 |
| 4,207,143 | 6/1980 | Glomb et al. | 162/207 |
| 4,253,247 | 3/1981 | Bergstrom | 34/155 |
| 4,358,900 | 11/1982 | Dove | 34/54 |
| 4,378,639 | 4/1983 | Walker | 34/12 |
| 4,444,622 | 4/1984 | Dove | 162/207 |
| 4,474,643 | 10/1984 | Lindblad | 162/198 |
| 4,543,737 | 10/1985 | Boissevain | 34/92 |
| 4,596,632 | 6/1986 | Goetz et al. | 162/136 |
| 4,609,432 | 9/1986 | Brucato | 162/141 |
| 4,685,221 | 8/1987 | Taylor et al. | 34/155 |
| 4,692,212 | 9/1987 | Swenson et al. | 162/206 |
| 4,718,982 | 1/1988 | Swenson et al. | 162/206 |
| 4,765,067 | 8/1988 | Taylor | 34/23 |
| 4,818,342 | 4/1989 | Wagle et al. | 162/207 |
| 4,828,650 | 5/1989 | Wagle et al. | 162/168.1 |
| 4,915,788 | 4/1990 | Winheim | 162/207 |
| 4,919,758 | 4/1990 | Wagle et al. | 162/175 |
| 4,977,687 | 12/1990 | Boissevain | 34/51 |
| 5,275,698 | 1/1994 | Dasgupta et al. | 162/177 |

FOREIGN PATENT DOCUMENTS 991965 5/1965 United Kingdom .

OTHER PUBLICATIONS

"Impulse Drying Promise in Reducing Energy Costs", By, Richard L. Ellis, Ph.D. *American Papermaker,* p. 35, Oct. 1990.

"New–Design Dry End Steam Showers Improve Sheet Quality, Runability", By, James A. Bourque, *Pulp and Paper,* May 1989.

"Drying and Ventilation" Chapter 10, By, H. G. Rappolt, *Pulp and Paper Science and Technology,* vol. 11, Paper, pp. 238–251, 1962.

Chapter I, "Analysis of Heat and Mass Transfer during Drying of Paper/Board", By, Shidharan Ramaswaym and Robert A. Holm, Given at Empire State Research Institutes (ESPRI) Meeting on Oct. 29, 1991.

*Primary Examiner*—W. Gary Jones
*Assistant Examiner*—Jose A. Fortuna
*Attorney, Agent, or Firm*—Luedeka, Neely & Graham

[57] ABSTRACT

The specification discloses an improved method for drying a paper or paperboard web emerging from the press section of a papermaking machine as it traverses a dryer unit. The method comprises continuously rewetting the web across its width during the initial web drying stage when the web has a solids content of no more than about 65 wt. %. The method improves the water removal rate and decreases the shrinkage rate of the web during drying.

17 Claims, 4 Drawing Sheets

REWETTING OF PAPER PRODUCTS DURING DRYING

FIELD OF THE INVENTION

The invention relates to the art of papermaking, and particularly to a method for improving paper or paperboard drying without adversely affecting the properties of the paper product.

BACKGROUND

The process of papermaking involves the formation of a web of fibers on a papermachine wire from a slurry of treated wood pulp, water removal from the fibers in the press roll section and in the dryer section of the papermaking machine, and final treatment of the paper by calendaring, chemicals and/or heat. In a typical papermaking process, the web from the press roll section contains about 32 to 35 wt. % solids. The solids may include wood pulp fibers and various additives such as sizing, binders, fillers, pigments and the like. The wet web is then passed through a series of internally heated rolls or steam-filled cylinders whereby the web is dried to about 94% solids content by weight. The number of dryer cylinders is determined by the amount of water to be evaporated based on a typical evaporation rate of about 2 pounds per hour per square foot of total dryer surface.

In the dryer section of the papermachine, water is removed from the web mainly by evaporation. Typically, the wet web is alternately contacted on its opposite sides with a series of hot cylindrical surfaces to heat the web to a temperature whereby water will evaporate from the web to a desired solids content.

Once dried, the paper or paperboard is generally further treated to improve various properties such as smoothness, gloss, wet strength and folding endurance. This subsequent treatment may include adjusting the moisture content of the dried web, densification on high pressure rolls, calendaring and/or heat treating the paper or paperboard product.

Various problems have persisted in the drying of paper webs on large, high-capacity paper machines. For example, drying of paper or paperboard products remains a high energy, capital intensive operation. Hence, the industry is constantly seeking to develop newer and more energy efficient drying techniques. Such drying techniques include high-intensity drying techniques whereby high temperatures and mechanical pressures are applied to the web during drying. Examples of currently used high-intensity drying techniques include press drying, impulse drying, and thermal/vacuum drying. However, the use of high temperature dryers and/or impulse dryers has led to additional problems such as delamination of linerboard products.

Furthermore, in the presently used high-intensity dryers, the paper may shrink by as much as 5 to 6% in the cross direction, i.e. in the direction perpendicular to the direction of travel through the papermaking machine. For wide sheets of paper or paperboard, such a shrinkage rate results in a significant reduction in the overall paper production rate.

Accordingly, even with the new high-intensity drying techniques, there still remains a need to further improve the drying of paper and paperboard products so as to reduce energy costs and reduce paper shrinkage while at the same time not adversely affecting any of the other physical properties of the finished paper or paperboard product.

Uneven drying is another problem which has persisted in drying paper webs. It has been known to apply moisture to portions of a web in the drying section of a paper making machine in order to prevent dry streaks and to assure uniform dryness across the width of the web. The weight and moisture irregularity of the fiber web before drying, irregularities in the heat transfer from the cylinders, edge effects and variations in the ventilation of the papermaking machine all tend to cause nonuniform drying in the cross-direction of the web. Such nonuniformity of drying has a negative effect on paper quality and may also result in increased waste. U.S. Pat. No. 4,378,639 to Walker and U.S. Pat. No. 4,474,643 to Lindblad propose solutions to the problem of uneven drying across the width of the web. These involve the periodic spraying of water on the web in selected areas across the width of the web where low moisture or dry streaks have been detected. Since only the areas of the web requiring moisture adjustment are sprayed, and only when streaking is sensed, the methods do not relate to improvement in the water removal rate.

It is therefore an object of the invention to improve the drying of paper and paperboard products without adversely affecting the physical properties of the finished product.

Another object of the invention is to increase the water removal rate from a paper or paperboard web in the drying portion of a paper and paperboard-making process.

Still another object of the invention is to provide a method for drying paper and paperboard whereby delamination and shrinkage of the paper and paperboard product is reduced.

Other objects and benefits of the invention will be evident from the ensuing discussion and appended claims.

SUMMARY OF THE INVENTION

With regard to the foregoing and other objects, the present invention is directed to an improved drying method for paper and paperboard products. According to its more general aspects, the method comprises drying an elongate paper or paperboard web emerging from the press section of a papermaking machine as it traverses a dryer unit. During the initial drying stages, the web is rewet with an amount of water substantially uniformly across the width of the web when the web has a solids content of no more than about 60 wt. %. The amount of water applied to the web preferably ranges from about 0.5 wt. % to about 10 wt. % based on the total weight of the web including liquid and solids, at each rewet step, most preferably from about 2 to about 6 wt. %, thereby decreasing the solids concentration of the web to about 56 to about 59 wt. %.

While fully rewetting the paper or paperboard web as it dries appears to be the antithesis of the intended objective; i.e., to dry the web, it has been found, quite surprisingly, that full cross-wise rewetting of a drying web when the solids content of the web is in the range of from about 45% to about 85% solids by weight, actually increases the overall rate of water removal as well as reduces the shrinkage rate of the web. Furthermore, the rewetting technique of the invention has been found not to adversely affect any of the other physical properties of the paper or paperboard product.

In another embodiment, the invention provides a method for increasing the drying rate of a paper or paperboard web without adversely affecting physical properties of the paper or paperboard product. The method comprises drying an elongate paper or paperboard web emerging from a press section of a papermaking machine as it traverses a dryer section to a temperature in the range of from about 100° to about 150° C., and continuously rewetting the web with an amount of water substantially uniformly throughout a cross-machine width of the web during an initial web drying stage when the web has a solids content in the range of from about 60 to about 85 wt. %. The amount of water added to the web preferably ranges from about 0.5 wt. % to about 10 wt. % based on the total weight of the web including liquid and solids, at each rewet step.

In yet another embodiment, the invention provides an improved paper or paperboard making process. The process comprises depositing paper or paperboard fibers on a web former screen thereby forming a web. The web is then wet pressed with one or more wet press nips to a solids content in the range of from about 45 to about 65% by weight. Drying of the web takes place on one or more co-rotating heated cylinders of a dryer unit arranged in series so that alternate sides of the web are placed on the cylinder surfaces as the web traverses the dryer unit. As the web is being dried, the web is continuously rewet with an amount of water substantially uniformly across the width of the web during an initial web drying stage, and before the web is dried to a solids content of greater than about 85 wt. %. The amount of water preferably added to the web during rewetting ranges from about 0.5 wt. % pounds to about 10 wt. % based on the total weight of the web including liquid and solids, at each rewet step. The paper or paperboard formed by the foregoing process has been found to have a cross-direction shrinkage rate of less than 2% as compared to greater than about 4 to 10% for conventional drying methods. Furthermore, there is an advantageous increase in the uniformity of the caliper of the web of paper or paperboard in the cross-machine direction by using the rewetting techniques of the invention.

DETAILED DESCRIPTION OF THE INVENTION

Figure 1:
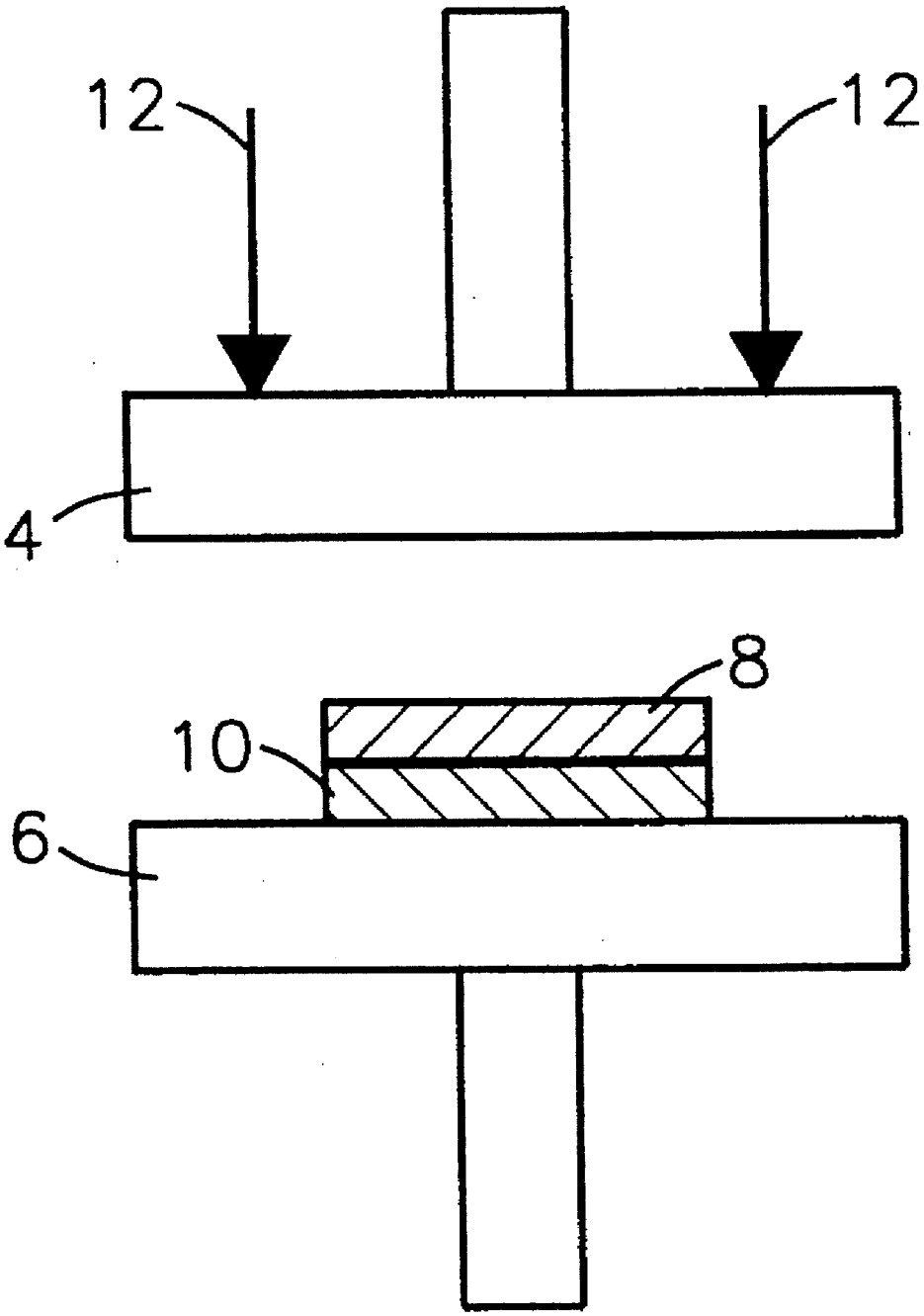
FIG. 1 is an illustration, not to scale, of a device used to simulate impulse drying of paper and paperboard products.

A key feature of the invention is the uniform widthwise continuous rewetting of an elongate paper or paperboard web in the drying section of a papermaking machine before the solids content of the web reaches a level of greater than about 85 wt. %. The process of the invention not only increase the drying rate of the web, but also improves one or more of the physical properties of the final paper or paperboard product. Accordingly, the cross directional shrinkage of the paper or paperboard product may be reduced by using the rewetting technique of the invention. Furthermore, the density, tensile strength compression and caliper uniformity in the cross-machine direction of the finished product may be increased. When preparing laminated products such as linerboard, the technique may also decrease the occurrence of delamination.

To perform the methods of the invention, paper or paperboard fibers are first deposited on a web former screen such as a Fourdrinier wire so as to form a web which is dewatered from an initial consistency (% solids) of 1 to 4 wt. % to 15 to 20 wt. % solids as it leaves the web forming end of the wire. Next, the web is pressed under pressure by the use of one or more nip rolls to increase the solids content of the web to about 45 to 50 wt. %.

Once it leaves the wet press rolls, the web is typically fed to the dryer section of the papermaking machine containing one or more stacked, co-rotating steam heated cylinders or rolls. The web traverses the cylinder stacks in an S-fashion at high speeds alternately exposing opposite faces of the web to the hot cylinder surface. Certain sections of the drying unit may include a continuous felt web for pressing the paper web against the cylinder surfaces.

When the solids content of the web is in the range of from about 45 to about 60 wt. %, the web is continuously uniformly rewet across the entire cross-machine width of the web so as to decrease the solids content of the web to between about 40 and about 59 wt. %. Drying continues during and after rewetting by contacting the web with additional heated cylinders. When the solids content of the web is in the range of from about 60 to about 63 wt. %, the web may be continuously uniformly rewet a second time across its width so as to decrease the solids content of the web to between about 53 and about 62 wt. %.

The sequence of rewetting and drying of the web is preferably repeated when the solids content of the web is in the range of from about 65 to about 68 wt. %, in the range of from about 70 to about 75 wt. % and in the range of from about 80 to about 85 wt. %. Each time the web is rewet, from about 0.5 wt. % to about 10 wt. % of water is preferably added to the web. Although five web rewetting cycles have been described, any number of web rewetting and drying cycles (more or less than 5) may be used provided the web is rewet at least once before the solids content of the web reaches about 85 wt. %. Furthermore, for different paper or paperboard products, some optimization of the web rewetting and drying procedure may be in order so as to achieve the most benefit from the methods of the invention.

As noted above, it is believed to be critical that the web is rewet at least once during the initial web drying stages before the solids content reaches about 85 wt. %. While not desiring to be bound by theoretical considerations, it is believed that rewetting the web at this critical time during the web drying sequence according to the invention may actually increase the rate of water removal from the web. In general, a web dries from the hot surface contact side of the web to the open air surface side of the web. As the web dries there is believed to be an advancing intermediate drying zone between the dry zone of the web material and the wet zone of the web material. The intermediate zone advances from the dry zone adjacent the hot surface contact side of the web to the open surface side of the web. In the dry zone of the web, most of the heat transferred from the hot surface of the dryer to the water contained in the intermediate and wet zones of the web is by convection. In the intermediate zone, water vaporizes and the vapors .flow into the wet zone of the web where the water vapor recondenses. In the wet zone of the web the heat transfer is mainly by conduction through the water in the web. Based on the above theoretical model of a web during drying, there may be both convective heat transfer and conductive heat transfer taking place in the intermediate zone of the web. Some energy is therefore expended vaporizing water in the intermediate zone of the web rather than conducting heat to the wet zone of the web whereby water can be removed by vaporization at the open surface of the web.

In accordance with the invention, when the zone adjacent the hot surface is rewet the amount of water evaporated in the intermediate zone may be reduced or eliminated. Accordingly, the heat from the hot contact surface of the web may be transferred by conduction through all zones of the web rather than by convection in the dry zone and convection and/or conduction in the intermediate zone of the web. The invention, therefore, is believed to reduce the amount of energy expended vaporizing water in the intermediate zone of the web and thus utilize more of the available heat energy to dry the web. Furthermore, there is less buildup of vapor in the web during drying and hence less chance for delamination of the plies of a multi-ply web.

An unexpected benefit of the process of the invention is the substantial reduction in the shrinkage rate of the web. Webs which are continuously rewet before the web reaches a solids content of about 85 wt. % exhibit a shrinkage rate of less than about 2% whereas a shrinkage rate of about 4 to about 10 is typical with conventional drying techniques.

In order to effectively rewet the web, a water spray, steam shower or moisture laden moving felt belt in contact with the web may be used to add sufficient moisture to the web. Water sprays, steam showers or moisture laden felt belts are well known in the art for spraying a web to control streaking and for other intermittent uses to address-non-uniformities in the dried web. See for example U.S. Pat. No. 2,661,669 to Friedrich, Jr.; U.S. Pat. No. 3,037,706 to Dupasquier; U.S. Pat. No. 3,838,000 to Urbas; U.S. Pat. Nos. 3,948,721 and 4,915,788 to Winheim; U.S. Pat. No. 4,207,143 to Glomb, et al.; U.S. Pat. No. 4,253,247 to Bergstrom; U.S. Pat. Nos. 4,358,900 and 4,444,622 to Dove; U.S. Pat. No. 4,378,639 to Walker; U.S. Pat. No. 4,474,643 to Lindblad; U.S. Pat. Nos. 4,543,737 and 4,977,687 to Boissevain; U.S. Pat. No. 4,596,632 to Goetz, et al.; U.S. Pat. No. 4,685,221 to Taylor, et al.; and U.S. Pat. No. 4,765,067 to Taylor incorporated herein by reference as if fully set forth. Unlike the above patents, however, the web is sprayed with a water mist fully across its width using a bank of sprayers or a wetted felt blanket on a continuous basis to decrease the solids content of the web to the desired degree before the solids content reaches about 85 wt. %. One or both sides of the web may be rewet by the foregoing procedures.

There is no particularly critical design for the web rewetting mechanism of the invention. Accordingly, water sprays of well known design may be added to existing or new drying equipment in order to rewet the web when the web reaches the preferred solids contents, or additional equipment may be added to existing or new drying equipment. Regardless of the dryer design, it is preferred to rewet the web or felt at a nip roll in order to insure more even distribution of the water on the web. The nip pressure may be provided solely by the weight of the nip roll, preferably a long, heated nip roll. Where practical, it is preferred to rewet the web directly rather than wetting a felt for contact with the web.

The water used to increase the moisture content of the paper or paperboard product need not be any particular temperature or quality. However, where there is concern for build-up of scale on the dryer cylinders, it may be desirable to use distilled or boiler feed water. The water sources not only include pure water, but may also include aqueous solutions or dispersions of coatings or additives normally used in the papermaking process. The water to be sprayed on the web may be at or below room temperature or the water may be at an elevated temperature.

As noted above, the web is preferably rewet a plurality of times during the drying procedure. For thicker web material, more rewetting and dryer cylinders may be required. For thinner web material, fewer cycles of rewetting and fewer dryer cylinders may be required. Those skilled in the art can readily determine the optimum number of rewetting and dryer cylinders for any given paper or paperboard product by conducting a few simple tests.

In order to further illustrate the advantages of the above described invention, the following non-limiting examples are given.

Example 1

In a series of drying experiments, three inch by three inch squares of 42 lbs/MSF paperboard were used. These samples were preconditioned to an initial solids content of about 30 wt. %. A Dynamic Compression Tester illustrated in FIG. 1 was used for all of the experiments.

With reference to FIG. 1, the three inch square web of paperboard 8 was placed on a three inch square felt pad 10 both of which were place on the cold plate 6 of the compression tester. To simulate impulse drying conditions, the hot plate 4 of the compression tester, at a temperature of 150° to 155° C., was pressed against the web 8 and felt pad 10 for 4 milliseconds at a pressure of 100 to 130 psig. (690 to 900 kPa). The results of simulated impulse drying of the web are given in Table 1 for control samples 1, 2 and 3 and rewet samples 4, 5, and 6. The samples were rewet by spraying water on the samples until the liquid content of the samples increased about 2 to about 17 wt. %, representing a decrease in the solids percent of about 2 to 16 wt. %. Samples 4–6 were each rewet three times during the drying procedure. Once the samples reached about 90 wt. % solids, the sheets were removed from the compression tester and dried in a laboratory flat plate drier for further physical analysis.

TABLE 1

| Test Sheet | No. of Presses | Solids (wt. %) (Init.–Fin.) | Solids Increase (wt. % per press) |
|---|---|---|---|
| Control 1 | 26 | 31–94 | 2.4 |
| Control 2 | 22 | 31–74 | 2.0 |
| Control 3 | 28 | 30–74 | 2.1 |
| Sample 4 | 8 | 30–48 | 2.0 |
| rewet | 7 | 46–62 | 2.3 |
| rewet | 6 | 57–74 | 2.8 |
| rewet | 7 | 72–84 | 1.7 |
| avg. | — | — | 2.3 |
| Sample 5 | 8 | 31–66 | 4.4 |
| rewet | 5 | 60–80 | 4.0 |
| rewet | 5 | 63–84 | 4.2 |
| rewet | 5 | 79–91 | 2.4 |
| avg. | — | — | 3.5 |
| Sample 6 | 9 | 31–57 | 2.9 |
| rewet | 5 | 53–68 | 3.0 |
| rewet | 5 | 57–74 | 3.4 |
| rewet | 7 | 68–83 | 2.1 |
| avg. | — | — | 2.8 |

Figure 2:
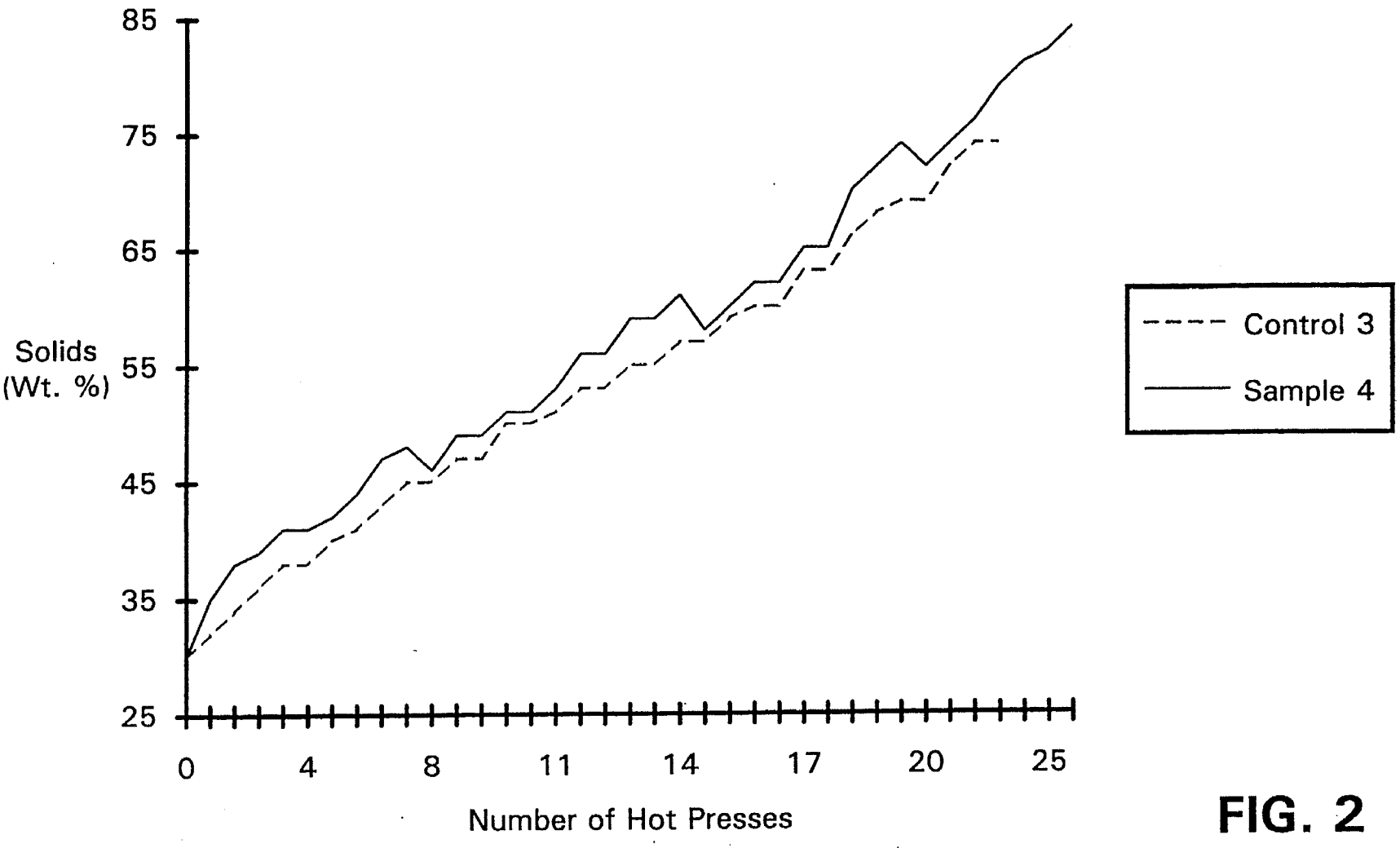
FIGS. 2–4 are graphic representations of the drying rates of the rewet webs of this invention compared to conventionally dried webs.
Figure 3:
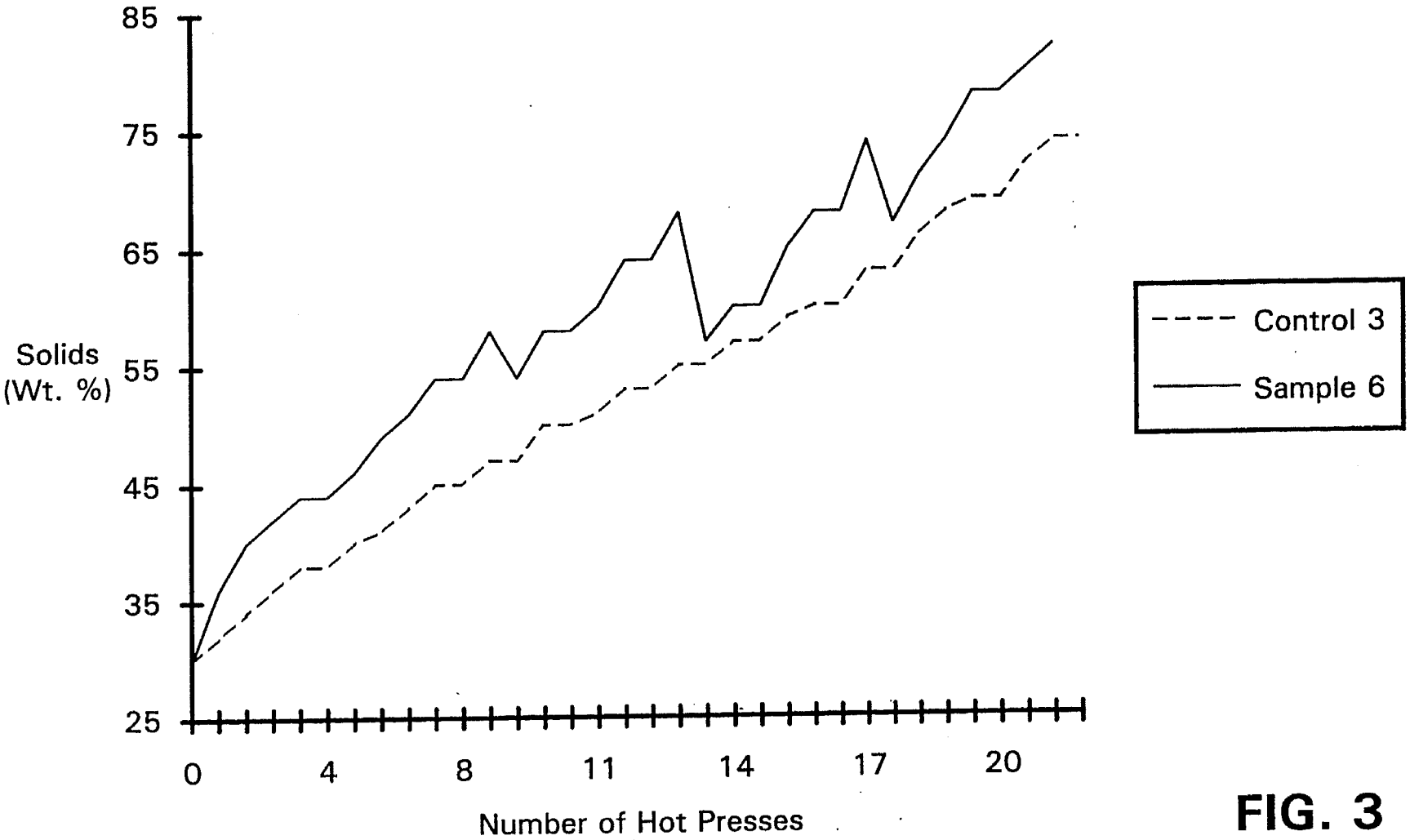
Figure 4:
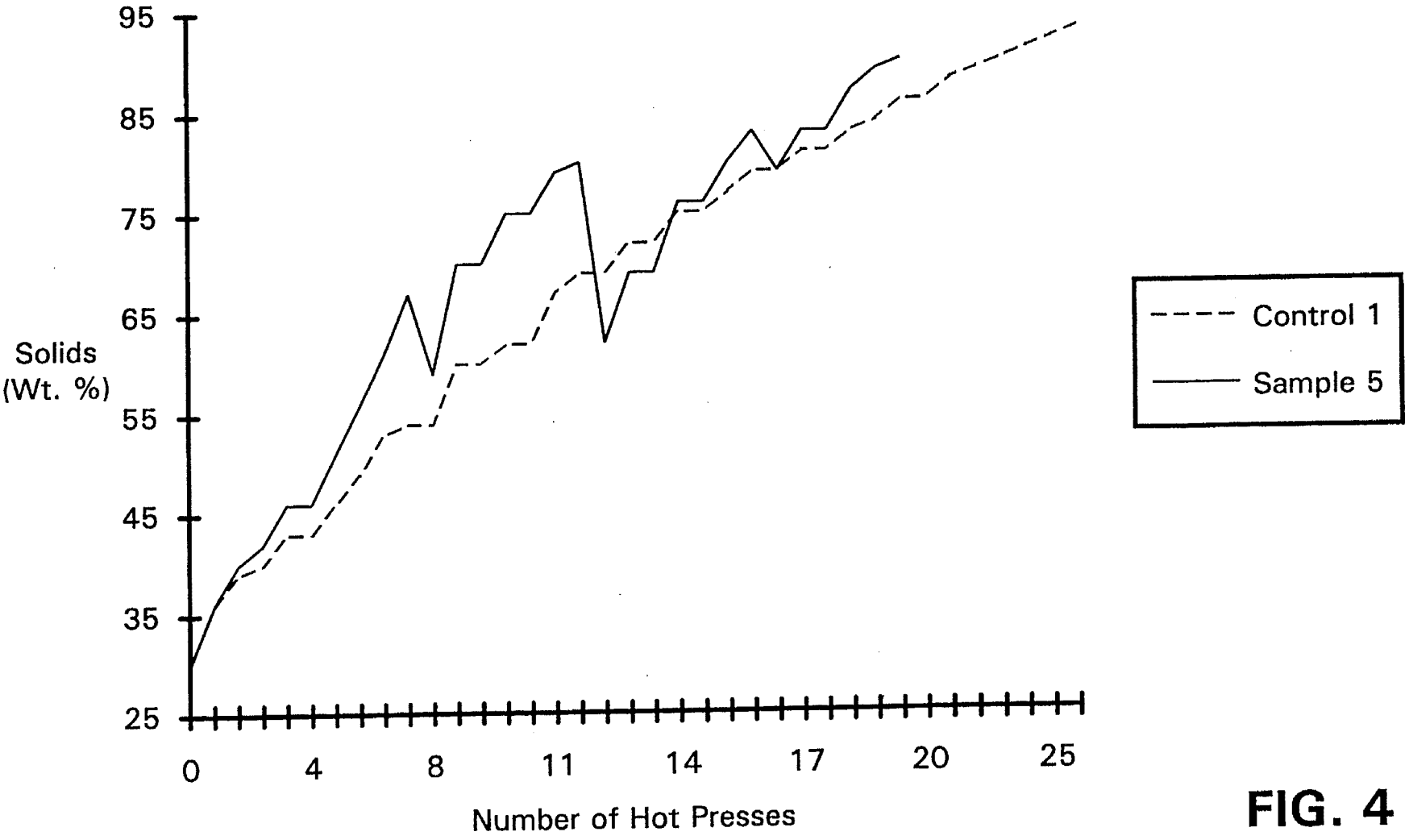

FIGS. 2–4 are graphical representations of the web drying characteristics of rewet samples 4, 5 and 6 and control samples 1, 2, and 3. In all of the figures, the rewet samples reached a higher percent solids sooner than did the control samples.

In the following Table 2, the average physical properties of control samples 1 and 2 were compared with the average physical properties of rewet samples 4 and 5.

TABLE 2

| | Control Samples | Rewet Samples | Change (%) |
|---|---|---|---|
| Basis Weight ($g/in^2$) | 227.3 | 246.2 | — |
| Caliper (0.001 inch) | 17.38 | 17.96 | — |
| Scott Bond ($ft/lb) \times 10^3$ | 73.2 | 90.5 | 23.6 |
| Density ($g/cm^3$) | 0.52 | 0.53 | — |
| STFI (lbf/in) | 19.2 | 21.9 | 14.0 |
| Tensile (lb/in) | 45.8 | 49.4 | 7.8 |
| MOE ($lb/in^2) \times 10^3$ | 96.7 | 117.8 | 21.8 |

In the foregoing table, the following standard methods of the Technical Association of the Pulp and Paper Industry (TAPPI) were used:

| Test | TAPPI No. |
|---|---|
| Density | T220 |
| Basis Weight | T220 |
| Caliper | T411 |
| Tensile | T494 |
| MOE | T494 |
| Scott Internal Bond | UM402 |
| STFI (Svenska Traforskningsinstitutet) Standard Compression (edge-wise) Test from Swedish Forest Products Research Labs, Stockholm | |

Example 2

In a series of samples, multi-ply board was pressed using the general procedure described in Example 1 above. The surface properties of the rewet samples of multi-ply board were compared with the unpressed samples, samples which were pressed at room temperature, and samples which were hot pressed but not rewetted. Rewetting of the samples was accomplished by spraying water onto the surface of the dry samples until the whole surface was wet in appearance. The hot press used to dry the samples was set at a pressure of 150 psig (1034 kPa), a temperature of 204° C. and a press time of 50 milliseconds. Results of the foregoing treatment are given in Tables 3, 4, and 5.

TABLE 3

Parker Roughness at 10 kgf/sq cm

| | Treatment Description | Sample 1 | Sample 2 | Sample 3 |
|---|---|---|---|---|
| A | No treatment | 9.58 | 9.64 | 9.50 |
| B | Room Temperature Press (twice) | 9.57 | 9.48 | 9.39 |
| C | Hot Press (twice), No rewet | 8.71 | — | — |
| D | Hot Press (twice), No rewet | 6.44 | 6.64 | 7.11 |
| — | Change in Samples A to D (%) | 33 | 31 | 25 |

TABLE 4

Sheffield Roughness

| | Treatment Description | Sample 1 | Sample 2 | Sample 3 |
|---|---|---|---|---|
| A | No treatment | 343 | 360 | 355 |
| B | Room Temperature Press (twice) | 352 | 358 | 349 |
| C | Hot Press (twice), No rewet | 287 | — | — |
| D | Hot Press (twice), With rewet | 345 | 329 | 315 |
| — | Change in Samples A to D (%) | 0 | 9 | 11 |

TABLE 5

GE Brightness

| | Treatment Description | Sample 1 | Sample 2 | Sample 3 |
|---|---|---|---|---|
| A | No treatment | 74.1 | 72.6 | 65.3 |
| B | Room Temperature Press (twice) | 74.2 | 72.5 | 65.3 |
| C | Hot Press (twice), No rewet | 74.0 | — | — |
| D | Hot Press (twice), With rewet | 73.6 | 72.1 | 65.2 |
| — | Change in Samples A to D (%) | 0 | 0 | 0 |

With reference to Tables 3–5, it appears that the Parker Print roughness improves considerably with rewetting followed by hot pressing, whereas the Sheffield smoothness is less affected and rewetting appears to have no effect on the brightness. The rewet and pressed samples also exhibited a shrinkage of less than about 2% whereas the hot pressed samples which were not rewet had a shrinkage of 5 to 6%.

Having thus described the invention and its preferred embodiments, it will be recognized that variations of the invention are within the spirit and scope of the appended claims.

What is claimed is:

1. A method for drying an elongate paper or paperboard web emerging from the press section of a papermaking machine as it traverses a dryer unit, which comprises continuously rewetting the web with an amount of water substantially uniformly across the width of the web during an initial web drying stage when the web has a solids content of no more than about 65 wt. %, wherein the amount of water added to the web ranges from about 0.5 wt. % to about 10 wt. % based on the total weight of the web including liquid and solids at each rewet step.

2. The method of claim 1 wherein the web is rewet at least twice in succession during the initial drying stage.

3. The method of claim 1 wherein the web is rewet three or more times in succession during the initial drying stage.

4. The method of claim 3 wherein the web is rewet in succession when the web has a solids content (i) in the range of from about 45 to about 60 wt. %, (ii) in the range of from about 60 to about 63 wt. %, (iii) in the range of from about 65 to about 68 wt. %, (iv) in the range of from about 70 to about 75 wt. % and (v) in the range of from about 80 to about 85 wt. %.

5. The method of claim 3 wherein the web is dried in an impulse dryer.

6. The method of claim 3 wherein the web is dried on a dryer with steam filled cylinders.

7. In a method for drying an elongate paper or paperboard web on a papermaking machine, the method for increasing the drying rate and reducing the shrinkage rate of the web without substantially adversely affecting physical properties of the web, the method comprising drying the web emerging from the press section of the papermaking machine as it traverses a dryer section to a temperature in the range of from about 100° to about 150° C., and during the drying, rewetting the web with an amount of water substantially uniformly across the width of the web during an initial web drying stage when the web has a solids content in the range of from about 60 to about 85 wt. % wherein the amount of water added to the web ranges from about 0.5 wt. % to about 10 wt. % based on the total weight of the web including liquid and solids, at each web rewet step.

8. The method of claim 7 wherein the web is rewet successively at least twice during said drying.

9. The method of claim 7 wherein the web is rewet three or more successive times during said drying.

10. The method of claim 9 wherein web is rewet in succession when the web has a solids content (i) in the range of from about 45 to about 60 wt. %, (ii) in the range of from about 60 to about 63 wt. %, (iii) in the range of from about 65 to about 68 wt. %, (iv) in the range of from about 70 to about 75 wt. % and (v) in the range of from about 80 to about 85 wt. %.

11. The method of claim 9 wherein the web is dried in an impulse dryer.

12. The method of claim 9 wherein the web is dried on a dryer with steam filled cylinders.

13. An improved paper or paperboard making process comprising:

depositing an aqueous slurry of paper or paperboard fibers at a consistency of from about 15 to about 20 wt. % on a web former screen thereby forming a relatively thin layer of the slurry on the screen;

dewatering the slurry on the screen thereby forming a fibrous web;

wet pressing the web with one or more wet press nips to a solids content in the range of from about 45 to about 50% by weight;

drying the web on one or more heated cylinders of a drying unit; and rewetting the web during the drying step with an amount of water substantially uniformly throughout the width of the web during an initial web drying stage before the web is dried to a solids content of greater than about 85 wt. %, whereby the paper or paperboard thus formed has a shrinkage rate of less than 5% and wherein the amount of water added to the web ranges from about 0.5 wt. % to about 10 wt. % based on the total weight of the web including liquid and solids, at each web rewet step.

14. The process of claim 13 wherein the web is rewet in succession at least twice during the said drying.

15. The process of claim 13 wherein the web is dried on at least four steam-heated drying cylinders and wherein the web is rewet in succession at least three times during said drying.

16. The process of claim 15 wherein the web is rewet in succession when the web has a solids content (i) in the range of from about 45 to about 60 wt. %, (ii) in the range of from about 60 to about 63 wt. %, (iii) in the range of from about 65 to about 68 wt. %, (iv) in the range of from about 70 to about 75 wt. % and (v) in the range of from about 80 to about 85 wt. %.

17. The process of claim 13 wherein a plurality of aqueous slurries of paper or paperboard fibers are deposited on the web forming screen thereby forming a multiply board.

* * * * *